United States Patent [19]

Endo

[11] 3,971,177

[45] July 27, 1976

[54] EARTH ANCHOR WORK METHOD AND ANCHOR DEVICE

[75] Inventor: Yuzo Endo, Urawa, Japan

[73] Assignees: Shoichi Kimura; Mitsui Construction Co., Ltd., both of Tokyo, Japan

[22] Filed: June 20, 1975

[21] Appl. No.: 588,656

[30] Foreign Application Priority Data

Jan. 9, 1975 Japan ..... 50-4655

[52] U.S. Cl. ..... 52/166; 52/698; 61/39; 61/53.52

[51] Int. Cl.[2] ..... E02D 5/74

[58] Field of Search ..... 52/166, 165, 698, 155, 52/156; 61/39, 53.5–53.68

[56] References Cited

UNITED STATES PATENTS

| | | | |
|---|---|---|---|
| 3,152,198 | 10/1964 | Williams | 61/39 |
| 3,188,815 | 6/1965 | Schuermann et al. | 52/698 X |
| 3,494,134 | 2/1970 | Jorge | 52/166 X |
| 3,507,121 | 4/1970 | Morfeldt | 61/53.52 X |
| 3,695,045 | 10/1972 | Williams | 52/698 |

*Primary Examiner*—J. Karl Bell
*Attorney, Agent, or Firm*—Lon H. Romanski

[57] ABSTRACT

An earth anchor device in which a plurality of flanged load-resistant plate couplers are removably screwed at predetermined intervals on a prestressing tendon (which usually may be cold drawn steel wire, or alloy steel wire or bar having high tensile strength, hereinafter referred to as "Tendon") forming the core portion of an earth anchor, a spring mechanism is closely annexed to the load-resistant surface of each of the flanged load-resistant plate couplers, and protective synthetic resin tubes each having an inner diameter slightly larger than the diameter of the Tendon are mounted over the peripheral portions of the Tendon which are exposed; and an earth anchor work method using such an anchor device. The anchor device is inserted into a bore drilled in the earth and embedded integrally with a charge of mortar forced into the bore, and after used, the Tendon of the anchor device is removable from the earth anchor device by being rotated about the axis thereof.

10 Claims, 13 Drawing Figures

EARTH ANCHOR WORK METHOD AND ANCHOR DEVICE

BACKGROUND OF THE INVENTION

1. Field of the Invention

This invention relates to an earth anchor work method and an anchor device for use as structure support in underground construction work in place of strutting for sheeting, and more particularly to a novel earth anchor work method and anchor device wherein the entire effective anchored length of the anchor may effectively resist and after used, a Tendon forming the core portion of the anchor body is readily removable.

2. Descrption Description the Prior Art

The known earth anchor work method and anchor device have often employed the so-called skin frictional resistance earth anchor wherein a Tendon is made integral with grouted mortar in the earth to form an anchor body and the skin frictional resistance between the peripheral surface of such anchor body and the surrounding earth is utilized to support pull-out force.

Such type of anchor has involved serious disadvantages which will be described below.

A first disadvantage of the conventional earth anchor is that the pull-out displacement of each portion of the anchor body is distributed along the embedded depth D in such a manner that the end pull-out displacement (tUn) tends to be much weaker than the head pull-out displacement (tUo), as a result of which the stress concentrates in the upper portion of the anchor to cause a progresive failure of the anchor from the upper to the lower portion thereof.

Generally, the relation between the skin frictional resistance and the displacement of the peripheral surface of the anchor body with respect to the earth E is such that, the skin frictional resistance reaches a peak at a certain value of displacement (usually 5 to 15 mm), whereafter it is sharply decreased. In such type of anchor, therefore, the entire effective anchored portion thereof does not effectively resist the pull-out force and thus, any increase in length of the effective anchored portion of the anchor body could not lead to a corresponding increase in potential tensile strength thereof. Also, the anchor body of this type if rigidly integral with the Tendon contained therewithin and is therefore subject to pull-out force at all times, so that the skin frictional resistance between the anchor body and the earth E is decreased with the increase in pull-out force due to Poisson's effect.

A second disadvantage is that the Tendon forming the core portion of the anchor body is made integral with mortar and after used, left embedded in the earth neighboring the site, and such left anchor would not only form an undestructible underground obstacle during a foundation work which might be carried out in future in that neighboring land, but also induce a trouble or quarrel with the owner of that land and further lead to a public problem. Furthermore, the core-forming Tendon of the conventional earth anchor, once used, has been discarded and this has meant a waste of steel material.

SUMMARY OF THE INVENTION

It is therefore an object of the present invention to provide an earth anchor work method and an anchor device therefor wherein the entire effective anchored length of the anchor body is resistant to pull-out forces and wherein pull-out displacement for each portion of the anchor body throughout the effective anchored length thereof may be distributed, as desired, in accordance with the skin frictional strength of the earth in which the anchor is embedded.

It is another object of the present invention to provide an earth anchor work method and an anchor device therefor wherein, after completion of an underground work or after use of the earth anchor, the Tendon forming the core portion of the anchor body may readily be removed from the earth by being rotated about the axis thereof, thus eliminating the probability that such steel material would form an undestructible obstacle in the earth in future.

It is still another object of the present invention to provide an earth anchor base wherein the Tendon forming the core portion of the anchor body is completely protected against water by protective sheath material or protective tubes surrounding the Tendon, whereby degeneration of the Tendon which would otherwise result from corrosion or the like may be prevented to ensure a permanently constant, great, tensile resistnce to be maintained while permitting reuse of the Tendon.

These objects of the present invention may be achieved by using an earth anchor base which comprises a plurality of flanged load-resistant plate couplers with spring mechanisms annexed thereto are removably screwed at predetermined space intervals on a Tendon forming the core portion of an earth anchor, and sheath material or protective tubes each having an inner diameter slightly larger than the diameter of the Tendon but less than the diameter of the load-resistant plate couplers, the sheath material or the protective tubes being mounted over the peripheral portion of the Tendon which is exposed.

The invention will become more fully apparent from the following detailed description thereof taken in conjunction with the accompanying drawings.

DESCRIPTION OF THE PREFERRED EMBODIMENTS

Figure 1:
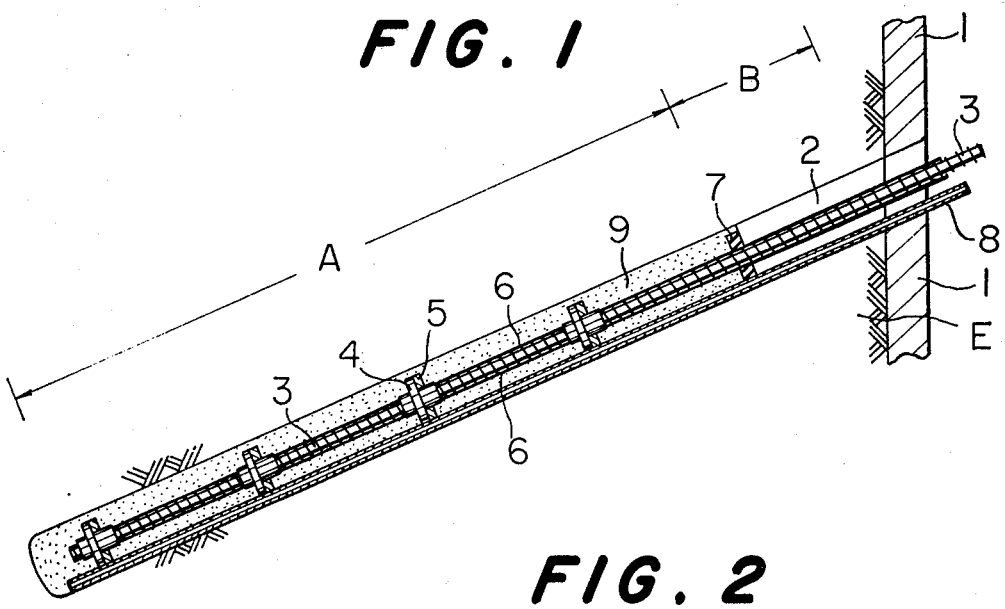
FIG. 1 is a side view showing the manner in which the earth anchor base according to the present invention is applied.

Referring to FIG. 1, there is shown a specific manner in which the present invention is used as a permanent earth anchor which eliminates the necessity of removing a Tendon forming the core portion of the earth anchor after completion of the construction work. As shown there, a bore 2 of desired depth is first drilled along a predetermined position in the earth E outside a sheeting 1 which is inserted contiguously with the outer peripheral wall portion of an area under construction work. Inserted into the bore 2 is an anchor device which comprises a Tendon 3, a plurality of flanged load-resistant plate couplers 4 integrally mounted on the Tendon 3 at predetermined space intervals as by means of screws, wedges or pressing, spring members 5 closely annexed to the load-resistant surfaces of the flanges of the respective load-resistant plate couplers 4, sheath material 6 such as vinyl tubes or spiral sheath applied between adjacent ones of the load-resistant plate couplers 4 and around the forward portion of the Tendon 3, a separator member 7 fitted on the Tendon at the boundary portion between an effective anchored portion A and a non-anchored portion B, and a mortar-pouring pipe 8 placed in the bore 2 longitudinally along the structure.

Figure 2:
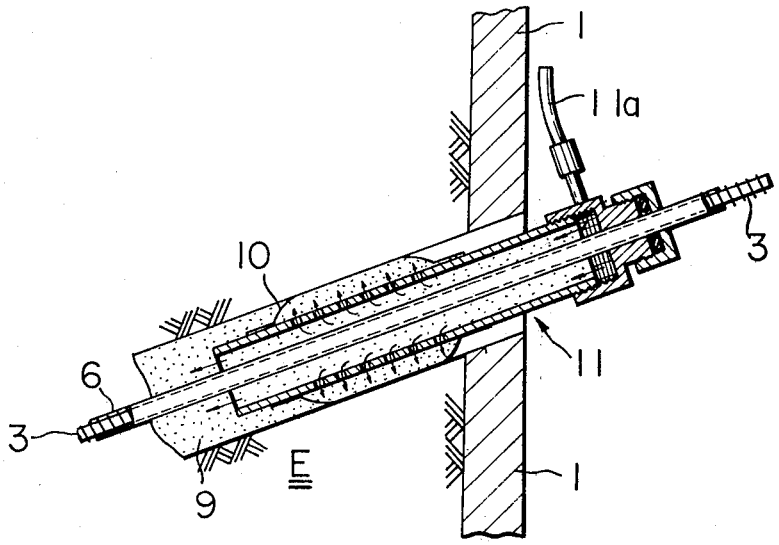
FIG. 2 illustrates a device for pressing the whole grouted mortar near the entrance of a drilled bore when the anchor base of FIG. 1 is embedded.

Subsequently, a charge of mortar 9 is poured through the pipe 8 into the bore 2 with the anchor device so inserted therein, until the mortar sufficiently fills the bore, whereafter the pipe 8 and the casing are pulled out together from the bore. Further, as shown in FIG. 2, to press the grouted mortar, a pressing device 11 with an inflatable bag 10 affixed thereto is inserted near the entrance of the bore, and a grout pump (not shown) is connected to a pressing hose 11*a* to permit an additional charge of mortar to be forced in to press the entire mortar.

Figure 3:
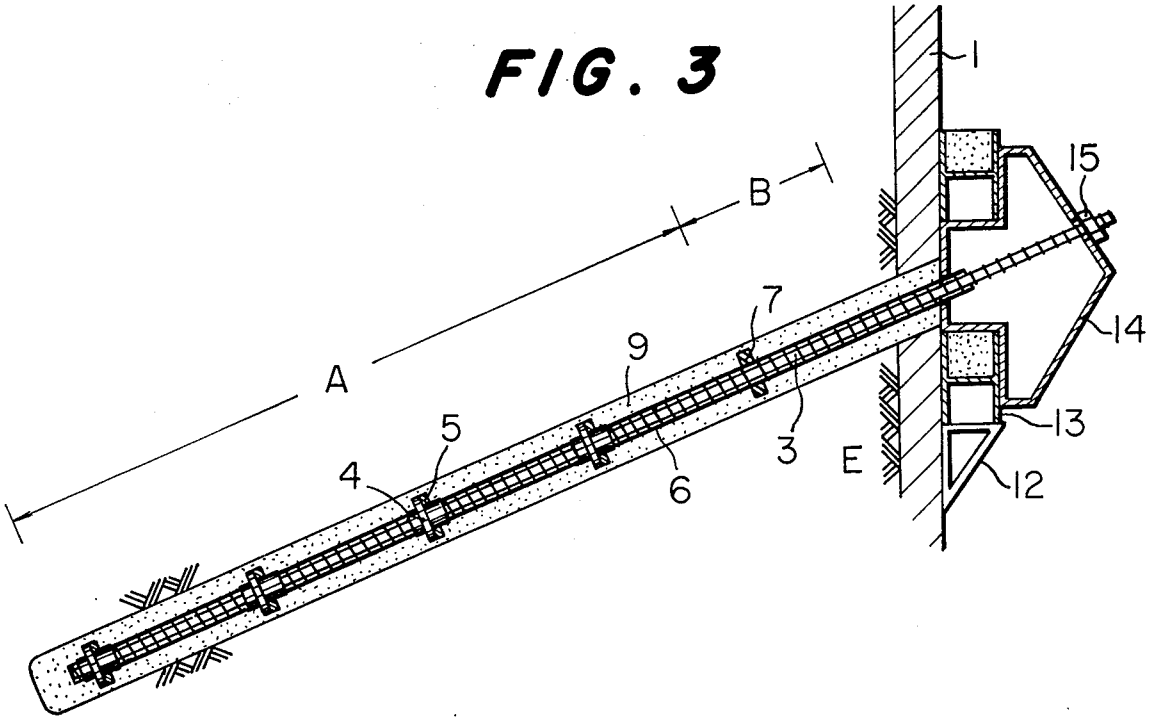
FIG. 3 is a side view showing an example of the coupling of the earth anchor to the sheeting surface.

The earth anchor embedded in the earth E may be coupled to the sheeting in the manner as shown in FIG. 3, for example, by integrally welding a right-angled bracket 12 to the outer surface of the sheeting portion just beneath the bore, mounting on the bracket 12 a set of wales 13 assembled together with a predetermined vertical spacing therebetween, and integrally welding to the front face of the wales 13 bearing pressure plate 14 for supporting the outwardly projected end portion of the Tendon 3. Thereafter, when the mortar exhibits a sufficient strength, the said projected end portion of the Tendon 3 is secured to the pressure plate 14 by an anchor nut 15 or wedges to thereby achieve anchoring with a predetermined pull-out force in accordance with designed load prestressed. Thus, in the earth anchor of the present invention, spring mechanisms are closely annexed to the flanged load-resistant surfaces of the load-resistant plate couplers, whereby the pull-out force is distributed into the flanged load-resistant surfaces of the respective load-resistant plate couplers at an appropriate ratio, so that the entire anchored length of the anchor may effectively resist the pull-out force. As a result, the sheeting 1 is made rigidly integral with the surrounding earth E with a very great tensile resistance, by means of the earth anchor.

Preferably, the flanged load-resistant plate couplers may each be formed as a unit by the use of any known material which has a relatively high strength, such as steel, iron, cast iron or the like, but in some cases, they may be formed of a composite material partly using hard plastics or the like.

Figure 4:
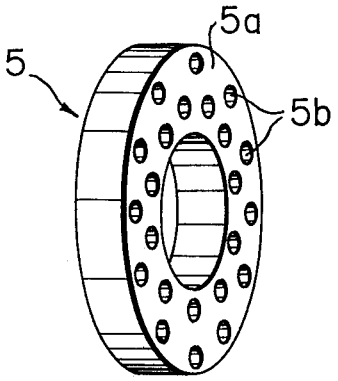
FIGS. 4 to 5*b* are perspective views and a cross-sectional view, respectively, showing a member of a spring mechanism closely annexed to the load-resistant surface of a flanged load-resistant plate coupler or a combination of members of such mechanism.

The spring mechanism annexed to the flanged load-resistant plate coupler 4 of the anchor base of the present invention may comprise a ring-shaped spring member 5, as shown in FIG. 4, which is formed of rubber, synthetic resin or similar elastic material, and may have its compression surface 5*a* formed with through-holes 5*b* as required. Moreover, it is to be understood that the spring constant of the spring mechanism may be adjusted, as desired, by increasing or decreasing the material or the unit of the base 5*a* and by varying the diameter and increasing or decreasing the number of the holes 5*b*, and further filling these holes with a different type of material to make a composite member.

A stress continuously applied to the ring-shaped spring member 5 for a long period of time would vary the spring constant thereof and might cause the intended spring function to be lost. To avoid this, use may be made of an alternative form of the spring mechanism as shown in FIGS. 5, 5*a* and 5*b*.

Figure 5:
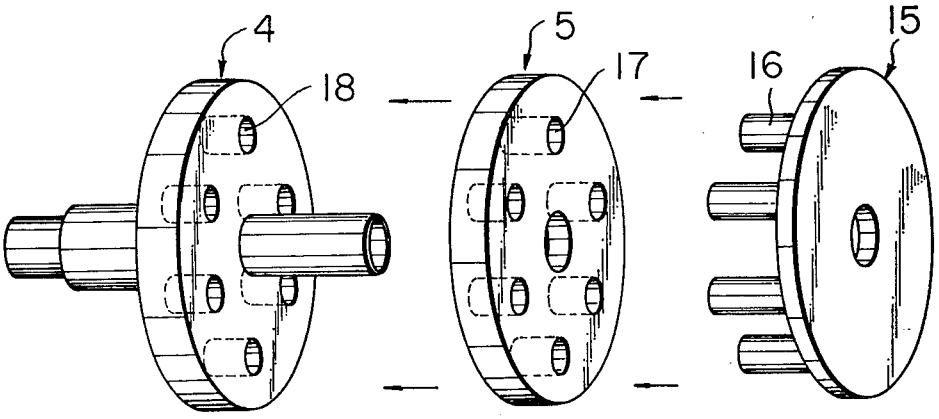
Figure 5A:
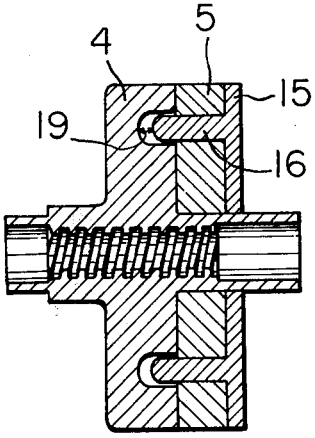
Figure 5B:
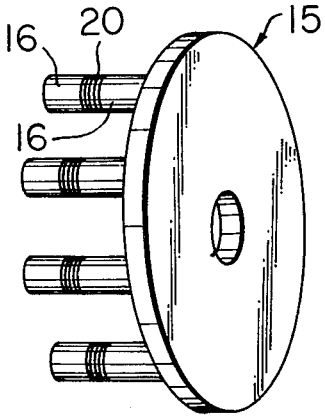

In FIG. 5, the spring mechanism employs a support plate 15 having a plurality of (preferably four to six) radially equally spaced and axially protruding pillar-like projections 16 formed thereon. The ring-shaped spring member 5 is formed with through-holes 17 corresponding to and for fully receiving the pillar-like projections 16 of the support plate 15, and likewise, the flanged load-resistant surface of the load-resistant plate coupler 4 is formed with blind holes 18 for receiving the aforementioned pillar-like projections 16 through the aforementioned through-holes 17 of the ring-shaped spring member, so that the support plate 15 may be fitted to the load-resistant plate coupler 4 with the ring-shaped spring member 5 sandwiched therebetween, by the pillar-like projections passing through the holes, in the manner as shown in FIG. 5*a*. The length of each of the pillar-like projections 16 may be adjusted so that a predetermined play space 19 may be provided between the end of each pillar-like projection and the bottom of each blind hole formed in the load-resistant surface of the load-resistant plate coupler when the support plate has been fitted into the blind holes with the spring member interposed therebetween under no-load condition. The adjustment of the length of the pillar-like projection may also be done, in the manner as shown FIG. 5*b*, by threadably securing a spring washer to each pillar-like projection in an intermediate portion thereof and by adjusting the thickness of such spring washer. By doing so, the pillar-like projections themselves may be provided with adjustable spring function. When a compression stress due to pull-out force is applied to the flanged load-resistant surface of the load-resistant plate coupler having the above-described spring mechanism, the end of each pillar-like projection is supported by the bottom of the corresponding blind hole even if the spring constant of the ring-shaped spring member is varied, and thus any further variation in the spring constant of the spring member may be prevented to thereby maintain the function of the spring mechanism constant.

The sheath material covering the peripheral portion of the Tendon inserted in the earth may be provided either by plastic tubes fitted thereover or by plastic film, fabric tape or metal foil tape spirally wound on the Tendon. It is essential that the Tendon and the mortar be insulated from each other.

Figure 6:
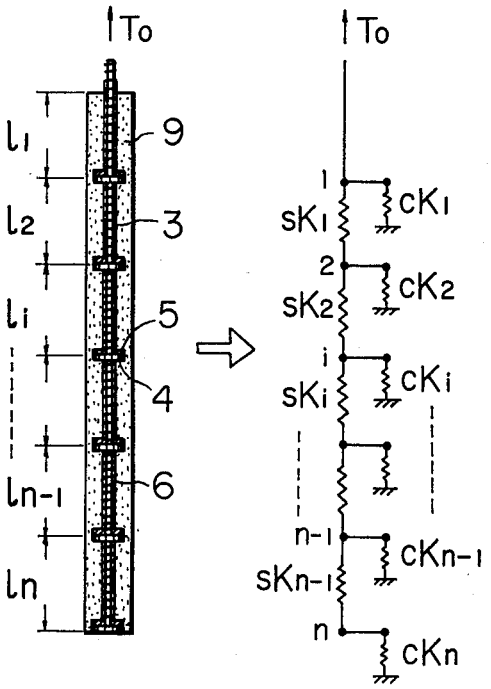
FIG. 6 illustrates the principle underlying the earth anchor work method of the present invention and a substituting system therefor.

The principle underlying the above-described method of the present invention will now be explained in greater detail. As shown in FIG. 6, an anchor body employing $n$ load-resistant plate couplers is substituted for by an idealized spring system and when the bearing pressure reaction and displacement of each load-resistant plate coupler are considered in the substituting system, it is possible to introduce the following equations with respect to the bearing pressure reaction Ri and displacement Ui of each load-resistant plate coupler:

$$cKi \cdot cUi = Ri \tag{3·1}$$

$$sKi \cdot sUi = To - \sum_{m=1}^{i} Rm \tag{3·2}$$

$$cKi - cU(i+1) = sUi \tag{3·3}$$

Hence, from equations (3·1) to (3·3), $$cKi = \frac{CUZ,8/27\ (cKi+1) \cdot sKi \cdot Ri}{ck(i+1)(To - \sum_{m=1}^{i} Rm) + cKi \cdot R(i+1)} \tag{3·4}$$

On the other hand, the fact that the entire anchored portion of the anchor body having $n$ load-resistant plate couplers effectively resists an pull-out force To means that the bearing pressure reaction Ri of the $i$th load-resistant plate coupler 3 due to the pull-out force is rendered to a constant ratio, i.e. Ri/uRi=const., with respect to the ultimate skin frictional bearing capacity uRi possessed between each section of the anchor body and earth E the foregoing equations, all of $$Ri(\sum_{i=1}^{n} Ri = To)$$

against the the pull-out force To can be determined on the basis of the length and outer diameter of each section of the anchor body, and the skin frictional strength of the surrounding earth.

Accordingly, the cKi which will match the bearing pressure reaction Ri may all be obtained by determining any one of the $n$ couplers in equation (3·4) above. Herein, cKi is a composite spring constant comprising the spring constant cKio of the anchor body and the spring constant bki of the spring mechanism, and may be expressed as:

$$cKi = \frac{cKio \cdot bKi}{cKio + bki} \tag{3·5}$$

Thus, the value of the necessary spring mechanism may be obtained from equation (3·5) by using the composite spring constant cKi obtained from equation (3·4) and the spring constant cKio of the anchor body.

Accordingly, the earth anchor having $n$ load-resistant plate couplers and its substituting system as shown in FIG. 6 may be mathematically expressed as follows:

$$sKi = \frac{As \cdot Es}{l(i+1)}$$

$$cKi = \frac{cKio \cdot bKi}{cKio +}$$

-continued $$bKi$$

$$cKio = \frac{sCi \cdot \phi}{\alpha i \cdot \coth(\chi i \cdot li)}$$

$$\alpha i = \sqrt{\frac{sCi \cdot 4}{Ac \cdot Ec}}$$

Where sKi : spring constant of the Tendon from point ($i$) to point ($i$+1)

cKi : composite spring constant comprising a combination of the spring constant of the anchor body and the spring constant of the spring mechanism at point ($i$)

cKio : spring constant of the anchor body at point ($i$)

To : pull-out force cUi : displacement of the load resistant plate at point ($i$)

sUi : elongation of the Tendon from point ($i$) to point ($i$+1)

Ac : cross-sectional area of the anchor body

Ec : Young's modulus of the anchor body

As : cross-sectional area of the Tendon

Es : Young's modulus of the Tendon $\phi$ : peripheral length of the anchor body sCi : modulus of skin frictional deformation between the anchor body and the earth E from point ($i$−1) to point ($i$)

Figure 7:
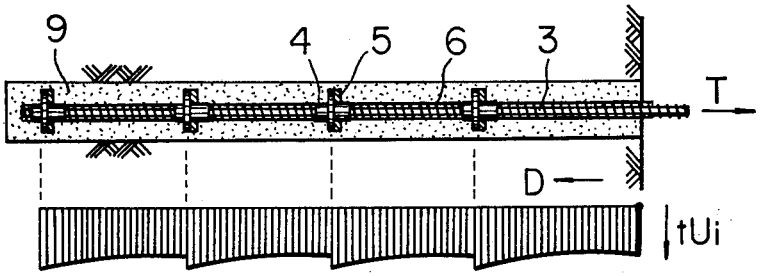
FIG. 7 is an illustration of the pull-out displacement for the earth anchor of the present invention when embedded in the earth of uniform strength.
Figure 8:
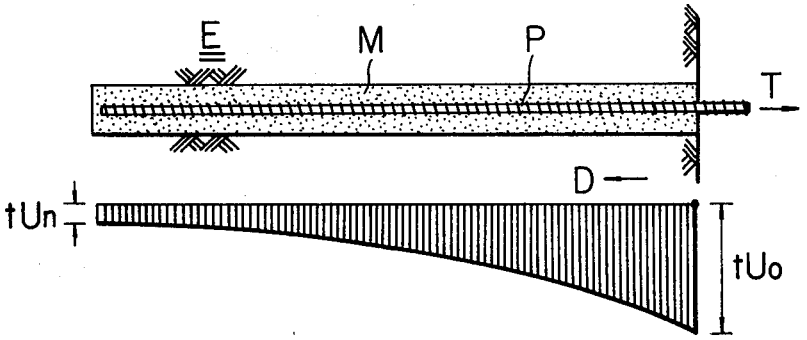
FIG. 8 illustrates the distribution of the pull-out displacement for the earth anchor according to the prior art.

According to the present invention, as will be apparent from the foregoing principle and as is shown in FIG. 7, the anchor body comprises a Tendon rod 3 and load-resistant plate couplers 4 having respective spring mechanisms annexed thereto and mounted on the Tendon 3 at predetermined space intervals and the anchor body is made integral with mortar, whereby the entire anchored length effectively resists the pull-out force T and the reaction of the flange of each load-resistant plate coupler is freely adjusted by the change in the spring constant of the spring mechanism, so that the pull-out displacement tUi of the entire body can be uniformly distributed and also, the entire anchored length can very effectively resist the pull-out force, thus highly enhancing the anchor efficiency as compared with the conventional anchor shown in FIG. 8.

Figure 9:
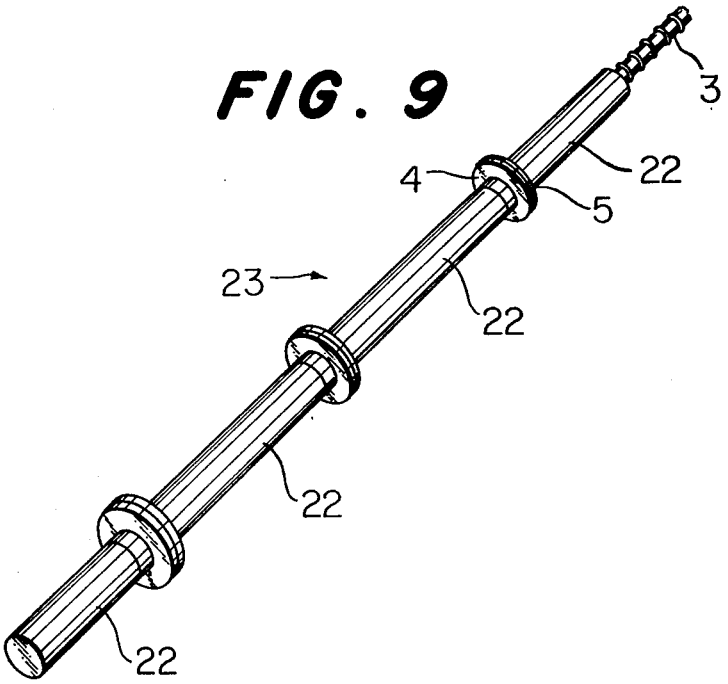
FIG. 9 is a perspective view showing another specific form of the earth anchor according to the present invention.
Figure 10:
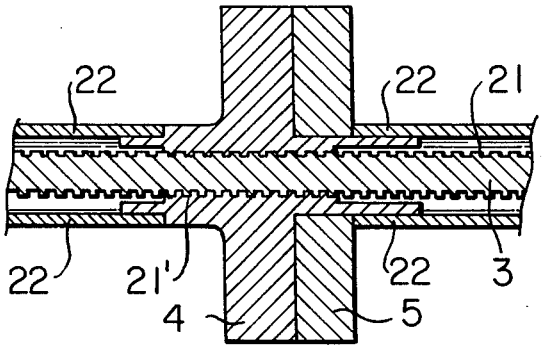
FIG. 10 is an enlarged, fragmentary, cross-sectional view showing the threadable engagement between the Tendon of the earth anchor base of FIG. 9 and a flanged load-resistant plate coupler.
Figure 11:
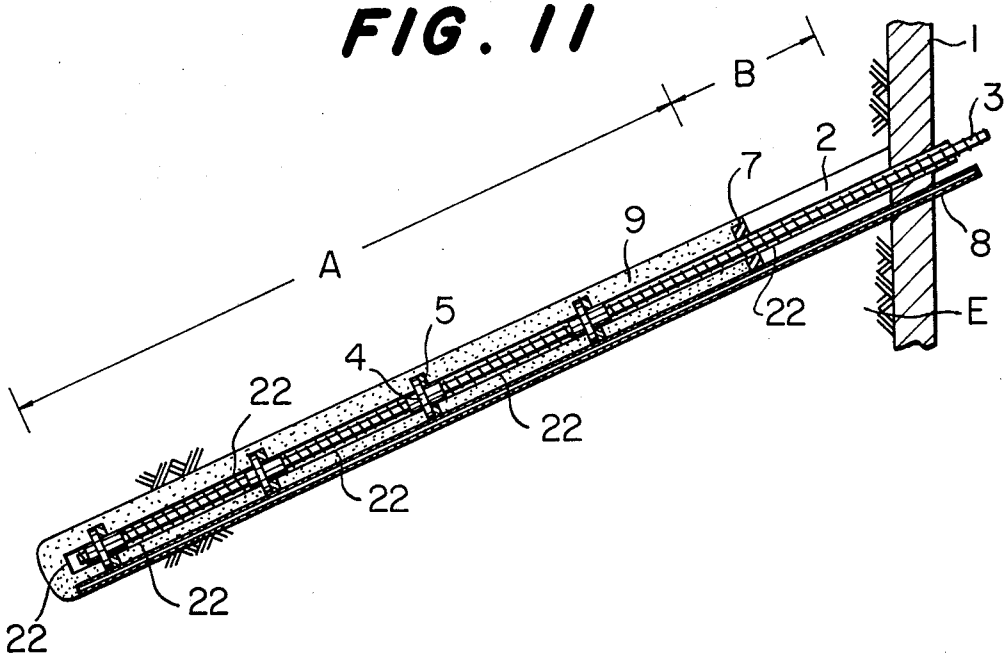
FIG. 11 is a cross-sectional view showing the manner in which the earth anchor body of FIG. 9 is applied.

Description will now be made of a removal anchor device for removing the Tendon forming the anchor core after the earth anchor has been used, and also of a removal anchor work method using such a device. As shown in FIGS. 9 and 10, flanged load-resistant plate couplers 4 are mounted at predetermined intervals on a connectible Tendon 3 having a threaded portion 21 formed on the entire peripheral surface thereof in a predetermined direction. The mounting of the load-resistant plate couplers onto the Tendon may be done with the aid of a threaded portion 21' formed in the inner wall of the load-resistant coupler 4 so as to correspond to the threaded portion 21 of the Tendon, that is, by rotating the load-resistant plate coupler 4 about the axis thereof so as to be removably screwed onto the Tendon 3. As already described, a spring mechanism comprising a spring member 5 alone or a spring member 5 with a support plate 15 fitted thereto is closely annexed to the load-resistant surface of each of the load-resistant plate couplers 4. When screwing the load-resistant plate couplers, protective tubes 22 each having an inner diameter slightly larger than the diameter of the Tendon are provided not only between adjacent ones of the load-resistant plate couplers secured to the Tendon, but also over the forward portion and the end portion of the Tendon; said protective tubes are mounted over all the peripheral portions of the Tendon which are exposed, whereby there is provided an earth anchor base 23.

The protective tubes may preferably be formed of synthetic resin, but of course, they may alternatively be wooden or bamboo tubes or the like.

It should be noted that the particular protective tube mounted between the forward end of the Tendon and the flanged load-resistant plate coupler screwed nearest that end has a closed end, between which end and the end of the Tendon there may be provided a predetermined play space. Thus, when the Tendon of the anchor base is coupled to the sheeting, the Tendon may be rotated about the axis thereof to thereby adjust the length of the Tendon which is projected from the earth.

Instead of mounting such protective tube at the end portion of the Tendon, it is also within the scope of the present invention that said end portion of Tendon may have threadably secured thereto a flanged load-resistant plate coupler having a closed end and formed so as to provide the above-described play space with respect to said end of the Tendon.

A mortar pouring pipe 8 is assembled to the so constructed earth anchor base 23, whereafter the assembly is embedded into a bore 2 drilled through the earth in the same manner as already described in connection with the anchor embedding method, and then a charge of mortar is poured through the pipe so as to be integral with the earth anchor body. An additional charge of mortar, connection of the earth anchor body to the sheeting, and mounting of the anchor may be effected in the same manner and the same sequence as previously described.

In this manner, the load-resistant plate couplers with spring mechanisms are removably mounted on the Tendon and the exposed portions of the Tendon are capped by the protective tube, whereby the Tendon 3 may be disposed in the bore 2 without making any direct contact with the mortar. As a result, removal of the Tendon, forming the core portion of the anchor body, from the earth anchor body after the use of the earth anchor may be accomplished by rotating the Tendon in one direction about the axis thereof to threadably release the Tendon 3 from the load-resistant plate couplers 4, thus removing the Tendon from the load-resistant plate couplers 4 and also from the protective resin tubes 22.

Accordingly, when the device is being used as anchor, pull-out force is distributed into the load-resistant surfaces of the load-resistant plate couplers at an appropriate ratio by the spring mechanisms annexed to said load-resistant surfaces, and after the use of the anchor is completed, the core-forming Tendon is removed, the result of which is that the absence of the Tendon in the earth anchor body will permit such base to be rapidly and easily dug up and cracked for removal when underground excavation work is to be effected later in the neighboring area. This is highly advantageous in that any foundation work in the neighboring area may progress without being hindered. Also, according to the present invention, the devices for supporting the sheetings can be embedded in that portion of the earth which is outside the main district within the work site, and this permits maximum utilization of the working space in underground work. This in turn leads to a greater ease of working and a lesser frequency of accidents as well as an enhanced working efficiency, and particularly allows for mechanical execution which may greatly shorten the period of time required for construction work.

Further, with the conventional earth anchor, it has been impossible to apply rust-resisting oil or the like to the Tendon in order to retain an anti-friction power between the Tendon and the mortar, whereas in the anchor base of the present invention the Tendon makes no contact with the mortar and this not only permits the Tendon to be kept for reuse with rust-resisting oil or the like applied thereto, but also prevents degeneration and/or loss of strength of the Tendon when being used as anchor base, thus ensuring the tensile strength thereof to be maintained at its theoretical value.

What we claim is:

1. An earth anchor work method for embedding in the earth an anchor body resistant to pull-out force, comprising the steps of drilling a bore in the earth, forming a unidirectionally threaded portion in the entire outer peripheral surface of a Tendon providing the core portion of said anchor body, threadably securing a plurality of flanged load-resistant plate couplers at any desired intervals axially on said Tendon with the aid of a threaded portion formed in the inner wall of each of said couplers and closely annexing a spring mechanism to the load-resistant surface of each of said flanged load-resistant plate couplers, mounting protective tubes over said Tendon at the forward end thereof, between adjacent ones of said load-resistant plate couplers and in other portions of the Tendon which are exposed, said protective tubes each having an inner diameter slightly larger than the diameter of said Tendon, thereby forming an anchor base, inserting said anchor base into said bore drilled in the earth while forcing a charge of mortar into said bore, to thereby make said anchor base and said mortar integral with each other.

2. An earth anchor base for earth anchor insertable into a bore of suitable depth provided at the anchor position in the earth, the improvement residing in that a plurality of flanged load-resistant plate couplers are mounted at any desired intervals axially on a Tendon providing the core portion of the anchor, a spring mechanism is closely annexed to the load-resistant surface of each of said flanged load-resistant plate couplers, and sheath materials cover the portions of said Tendon which are exposed.

3. An earth anchor base for earth anchor insertable into a bore of suitable depth provided at the anchor position in the earth and having an anchor-core-forming Tendon removable after the use of the anchor, the improvement residing in that a unidirectionally threaded portion is formed in the entire outer peripheral surface of said Tendon forming the core portion of the anchor body, a plurality of flanged load-resistant plate couplers are threadably secured at any desired intervals axially on said Tendon with the aid of a threaded portion formed in a part or the whole of the inner wall of each of said couplers so as to be complementary to said external threaded portion of said Tendon, a spring mechanism is closely annexed to the load-resistant surface of each of said flanged load-resistant plate couplers, and protective tubes each having an inner diameter slightly larger than the diameter of said Tendon are mounted on the portions of said Tendon which are exposed.

4. An earth anchor base according to claim 2, wherein said spring mechanism closely annexed to each of said flanged load-resistant plate couplers is formed of rubber, plastics or other elastic material.

5. An earth anchor base according to claim 2, wherein said spring mechanism closely annexed to each of said flanged load-resistant plate couplers comprises a combination of a support plate having a plurality of radially equally spaced and axially protruding pillar-like projections and an elastic spring member having a corresponding number of through-holes corresponding to and for receiving said pillar-like projections of said support plate, and a plurality of blind holes corresponding to said through-holes in said spring member are formed in the load-resistant surface of each of said flanged load-resistant plate couplers for receiving said pillar-like projections with a predetermined play space.

6. An earth anchor base according to claim 5, wherein each of said pillar-like projections of said support plate forming said spring mechanism includes one or more spring washers.

7. An earth anchor base according to claim 3, wherein said spring mechanism closely annexed to each of said flanged load-resistant plate couplers is formed of rubber, plastic or other elastic material.

8. An earth anchor base accordng to claim 3, wherein said spring mechanism closely annexed to each of said flanged load-resistant plate couplers comprises a combination of a support plate having a plurality of radially equally spaced and axially protruding pillar-like projections and an elastic spring member having a corresponding number of through-holes corresponding to and for receiving said pillar-like projections of said support plate, and a plurality of blind holes corresponding to said through-holes in said spring member are formed in the load-resistant surface of each of said flanged load-resistant plate couplers for receiving said pillar-like projections with a predetermined play space.

9. An earth anchor base according to claim 8, wherein each of said pillar-like projections of said support plate forming said spring mechanism includes one or more spring washers.

10. An earth anchor base according to claim 3, wherein a flanged load-resistant plate coupler having a closed end is threadably fitted to the end portion of said Tendon.

* * * * *